US011521626B2

(12) United States Patent
Le Razavet et al.

(10) Patent No.: US 11,521,626 B2
(45) Date of Patent: Dec. 6, 2022

(54) DEVICE, SYSTEM AND METHOD FOR IDENTIFYING A SCENE BASED ON AN ORDERED SEQUENCE OF SOUNDS CAPTURED IN AN ENVIRONMENT

(71) Applicant: ORANGE, Issy-les-Moulineaux (FR)

(72) Inventors: Danielle Le Razavet, Chatillon (FR); Katell Peron, Chatillon (FR); Dominique Prigent, Chatillon (FR)

(73) Assignee: ORANGE, Issy-les-Moulineaux (FR)

( * ) Notice: Subject to any disclaimer, the term of this patent is extended or adjusted under 35 U.S.C. 154(b) by 0 days.

(21) Appl. No.: 17/033,538

(22) Filed: Sep. 25, 2020

(65) Prior Publication Data

US 2021/0098005 A1 Apr. 1, 2021

(30) Foreign Application Priority Data

Sep. 27, 2019 (FR) ..... 1910678

(51) Int. Cl.
*G10L 19/008* (2013.01)
*H04S 3/00* (2006.01)
*G10L 25/51* (2013.01)

(52) U.S. Cl.
CPC ..... *G10L 19/008* (2013.01); *H04S 3/008* (2013.01); *H04S 2400/01* (2013.01)

(58) Field of Classification Search
CPC .. H04R 29/00; H04R 25/405; G08B 13/1672; G10L 15/22; G10L 15/285; G10L 17/26; G10L 19/008; G10L 19/00; G10L 25/03; G10L 25/00; G10L 25/51; G10L 25/50; G06F 3/017; H04W 64/00; H04N 7/18; H04S 3/008; H04S 3/00; H04S 2400/01
USPC ..... 381/1–23; 704/500–504
See application file for complete search history.

(56) References Cited

U.S. PATENT DOCUMENTS

2009/0180628 A1* 7/2009 Stephanson ..... G08B 13/1672 381/58
2016/0077574 A1* 3/2016 Bansal ..... G06F 1/28 704/275

OTHER PUBLICATIONS

Brian Clarkson et al "Auditory Context Awareness via Weable Computing", Proceedings of 1998 Workshop on Perceptual User Interfaces, Jan. 1, 1998, XP 055677044 (IDS submitted on Sep. 25, 2020) (Year: 1998).*

English translation of the Written Opinion dated Mar. 17, 2020 for corresponding French Application No. 1910678, filed Sep. 27, 2019.

Brian Clarkson et al., "Auditory Context Awareness via Wearable Computing", Proceedings of 1998 Workshop on Perceptual User Interfaces, Jan. 1, 1998 (Jan. 1, 1998), XP 055677044.

(Continued)

*Primary Examiner* — Leshui Zhang
(74) *Attorney, Agent, or Firm* — David D. Brush; Westman, Champlin & Koehler, P.A.

(57) ABSTRACT

An identification device, method and system for identifying a scene in an environment. The environment includes at least one sound capture device. The identification device is configured to identify the scene based on at least two sounds captured in the environment. Each of the at least two sounds are associated respectively with at least one sound class. The scene is identified by taking account of a chronological order in which the at least two sounds were captured.

10 Claims, 3 Drawing Sheets

(56) References Cited

OTHER PUBLICATIONS

Figure 1:
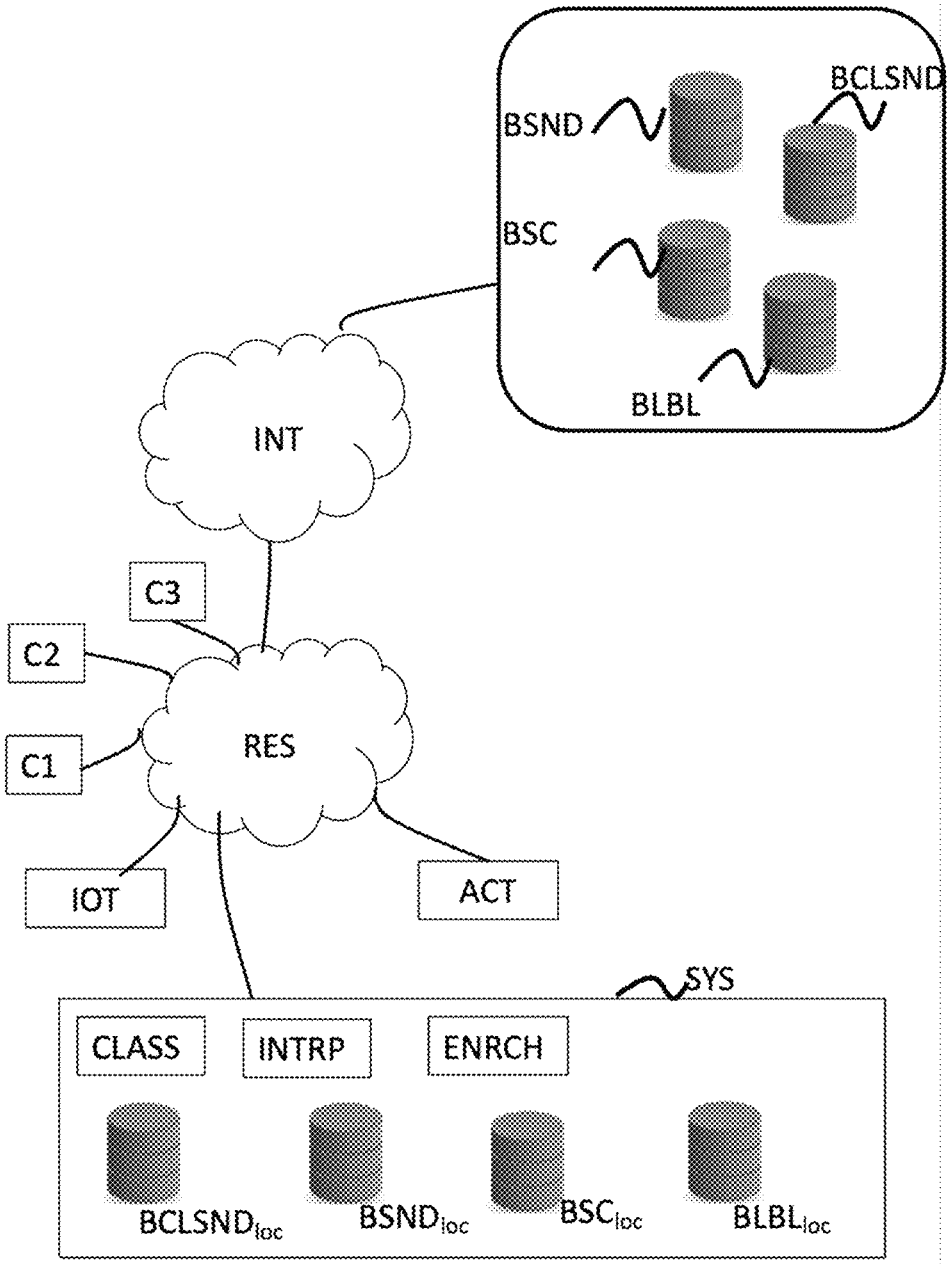

Chakrabarty Debmalya et al., "Exploring the Role of Temporal Dynamics in Acoustic Scene Classification", 2015 IEEE Workshop on Applications of Signal Processing to Audio and Acoustics (WASPAA), IEEE Oct. 18, 2015 (Oct. 18, 2015), pp. 1-5, XP032817953.
Barchiesi Daniele et al., "Acoustic Scene Classification: Classifying Environments from the Sounds They Produce", IEEE Signal Processing Magazine, IEEE Service Center, Piscataway, NJ, US, vol. 32, No. 3, May 1, 2015 (May 1, 2015), pp. 16-34, XP011577488.

* cited by examiner

DEVICE, SYSTEM AND METHOD FOR IDENTIFYING A SCENE BASED ON AN ORDERED SEQUENCE OF SOUNDS CAPTURED IN AN ENVIRONMENT

1. FIELD OF THE INVENTION

The invention concerns a system for identifying a scene based on sounds captured in an environment.

2. PRIOR ART

Systems for identifying situations or use cases can be of particular interest for domestic or professional use, especially in the case of situations detected that require urgent actions to be performed.

For example, in the case of a homebound elderly person, a surveillance system could identify situations requiring intervention.

Such systems can also be of interest in the case of scenes that are not urgent in nature, which systematically require a set of repetitive actions for which the automation of these repetitive actions would be beneficial for the user (for example: locking of a door after the departure of the last occupant, placing radiators on standby, etc.).

Such systems can also be of interest for disabled persons for whom the system can be an aid.

Such situation identification systems can also be of interest in a domestic or professional field, for example in the case of surveillance systems for business or domestic use during the absence of the persons occupying the business or home, for example in order to prevent intrusion, fire, water damage, etc., or also in the case of systems providing various services to users.

At the present time, there is no industrial recognition/identification solution for situations, events or use cases whose operation is based on the identification of several sounds.

The existing systems based on sound recognition, such as that of the company "Audio Analytics", only target the identification of a single sound among the ambient sounds captured. Such a system does not identify a situation associated with the identified sound. The interpretation of the sound is left to the responsibility of a third party, who is free to determine for example if broken glass identified by the equipment is due to an intrusion or a domestic accident.

Current sound identification systems use sound databases that are currently insufficiently provisioned and varied, both in terms of number of classes, but also regarding the number of samples per class. This insufficient number of samples does not take account of the variability of sounds in daily life and can lead to erroneous identifications.

Current techniques for identifying sounds and their emitters are based on comparisons with sound class models. These models are built from often badly qualified databases. They are therefore likely to generate approximate results, or even errors or misinterpretations.

The Sound Databases that are available and accessible, freely or otherwise (such as the Freesound collaborative database or the Google database "Google Audio Set") are extremely heterogeneous in terms of the quantity and quality of the sound samples.

In addition, they are lacking in effective search or selection systems, as the audio samples are insufficiently documented and qualified. When searching for a sample, it is after a series of manual auditory tests of a large number of sound samples identified on the basis of one or two simple criteria: transmitter, state (cat, dog, coffee machine, etc.) that the selection of an ad-hoc sound can be envisaged.

All these difficulties lead to uncertainty concerning the sound classes recognized and significantly reduces the performance of a system for identifying a situation that would be based on the identification of a captured sound. Such a system of ambient intelligence could therefore become ineffective, inadequate (such as notifying the police when just a glass has been broken), or even dangerous.

Systems for computational analysis of sound scenes relative to activities (such as cooking) are still in the research stage. These are based on the analysis of a corpus of recurring unidentified sources, which in the long term will therefore not help to better qualify the classes of reference sounds to generate models. Today, thanks to machine-learning techniques, these methods make it possible to categorize habitual and repetitive contexts, but they are badly suited to analyzing exceptional sound events.

3. SUMMARY OF THE INVENTION

The invention improves the state of the art. For this purpose, it concerns a device for identifying a scene in an environment, said environment comprising at least one sound capture means. The identification device is configured for identifying said scene based on at least two sounds captured in said environment, each of said at least two sounds being associated respectively with at least one sound class, said scene being identified by taking account of the chronological order in which said at least two sounds were captured.

The invention therefore proposes a device for identifying a scene based on sounds captured in an environment. Advantageously, such a device is based on a chronological succession of sounds captured and classified in order to distinguish scenes when a same captured sound may correspond to several possible scenes.

Indeed, a scene identification system based on the identification of a single sound captured in the environment would be unreliable, as in certain cases, a captured sound can correspond to several possible interpretations, therefore several possible identified situations or scenes. Indeed, when a scene is only characterized by a single sound, several different scenes can correspond to a same acoustic fingerprint. For example, a sound of broken glass can be associated with an intrusion scene or a domestic accident, both scenes corresponding to two distinct situations which are likely to generate different appropriate responses.

In addition, the identification device according to the invention makes it possible to reduce uncertainty in identifying the sound source. Indeed, certain sounds can have similar acoustic fingerprints that are difficult to distinguish: for example, the sound of a vacuum cleaner and the sound of a ventilator, yet these sounds do not reveal the same situation respectively. Consideration of several sounds and the chronological order in which these sounds are captured ensures the reliable results of the scene identification device. Indeed, scene interpretation is improved by considering several sounds captured while this scene is occurring, as well as the chronological order in which these sounds occur.

According to one particular embodiment of the invention, the scene is identified among a group of predefined scenes, each predefined scene being associated with a predetermined number of marker sounds, said marker sounds of a predetermined scene being arranged in chronological order.

According to another particular embodiment of the invention, the device is also configured for receiving at least one piece of complementary data provided by a connected device from said environment and for associating a label with a sound class from a captured sound or with said identified scene. According to this particular embodiment of the invention, the connected devices placed in the environment in which the sounds are captured transmit complementary data to the identification device.

Such complementary data can for example be information on the location of the captured sound, temporal information (time, day/night), temperature, service type information: for example, home automation information indicating that a light is switched on, a window is open, weather information provided by a server, etc.

According to this particular embodiment of the invention, labels are predefined in relation to the type and value of the complementary data likely to be received. For example, labels of the type: day/night are defined for complementary data corresponding to a schedule, labels of the type: hot/cold/moderate are defined for complementary data corresponding to temperature values, labels representing location can be defined for complementary data corresponding to the location of the captured sound. In certain cases, the complementary data can also correspond directly to a label, for example a connected device can transmit a location label which it was attributed beforehand . . . .

Hereon, a label can also be called a qualifier.

According to this particular embodiment of the invention, the complementary data make it possible to qualify (i.e. describe semantically) a sound class or an identified scene. For example, for a captured sound corresponding to flowing water, information on the location of the captured sound will make it possible to describe the sound class using a label associated with the location (for example: shower, kitchen, etc. . . . ).

According to another particular embodiment of the invention, the device is also configured, when a captured sound is associated with several possible sound classes, to determine a sound class from said captured sound using said at least one piece of complementary data received. According to this particular embodiment of the invention, the complementary data make it possible to distinguish sounds having similar acoustic fingerprints. For example, for a captured sound corresponding to flowing water, information on the location of the captured sound will make it possible to distinguish whether the sound should be associated with a sound class such as a shower or a sound class such as rain.

Alternatively, the complementary data can be used to refine a sound class by creating new and more precise sound classes based on the initial sound class. For example, for a captured sound that has been associated with a sound class corresponding to flowing water, information on the location of the captured sound will make it possible to describe the captured sound using a label associated with the location (for example: shower, kitchen, etc.). A new sound class such as water flowing in a room such as a shower/kitchen can be created. This new sound class will therefore be more precise that the initial "water flowing" sound class. It will allow finer analysis during subsequent scene identifications.

According to another particular embodiment of the invention, the device is also configured for triggering at least one action to be performed following the identification of said scene.

According to another particular embodiment of the invention, the device is also configured for transmitting to an enrichment device at least one part of the following data:

- one piece of information indicating the identified scene, and at least two sound classes and a chronological order associated with the identified scene,
- at least one part of the audio files corresponding to the captured sounds associated respectively with a sound class,
- where appropriate at least one sound class associated with a label.

The invention also concerns a system for identifying a scene in an environment, said environment comprising at least one sound capture means, said system comprises:

- a classification device configured for:
  - receiving sounds captured in said environment,
  - determining for each sound received, at least one sound class,
- an identification device according to any one of the particular embodiments described here above.

According to one particular embodiment of the invention, the identification system comprises in addition an enrichment device configured for updating at least one database with at least one part of the data transmitted by the identification device.

According to this particular embodiment of the invention, the system according to the invention allows the enrichment of existing databases, as well as the relations linking the elements of these databases with each other, for example:

- a database of sounds using at least one part of the audio files corresponding to the captured sounds,
- a database of qualifiers using labels obtained by the complementary data, for example,
- the relations between audio files, sound classes and complementary labels (qualifiers) originating from sensor or service data.

The invention also concerns a method for identifying a scene in an environment, said environment comprising at least one sound capture means, said identification method comprises the identification of said scene from at least two sounds captured in said environment, each of said at least two sounds being associated respectively with at least one sound class, said scene being identified by taking account of the chronological order in which said at least two sounds were captured.

According to one particular embodiment of the invention, the identification method also comprises the updating, of at least one database, using at least one part of the following data:

- one piece of information indicating the identified scene, and at least two sound classes and a chronological order associated with the identified scene,
- at least one part of the audio files corresponding to the captured sounds associated respectively with one sound class,
- where appropriate at least one sound class associated with a label.

The invention also concerns a computer program comprising instructions for implementing the aforementioned method according to any of the particular embodiments previously described, when said program is executed by a processor. The method can be implemented in various ways, especially in wired or software form. This program can use any programming language, and take the form of source code, object code, or intermediary code between source code and object code, such as in a partially compiled form, or in any other desirable form.

The invention also targets a machine-readable recording medium or information carrier, and comprising computer program instructions such as mentioned here above.

The aforementioned recording media can be any entity or device capable of storing the program. For example, the medium can comprise a storage means, such as a ROM device, for example a CD ROM or a microelectronic circuit ROM, or even a magnetic recording means, for example a hard drive. Furthermore, the recording media can correspond to a transmissible medium such as an electrical or optical signal, which can be routed via an electrical or optical cable, by radio or by other means. The programs according to the invention can in particular be downloaded onto an Internet type network.

Alternatively, the recording media can correspond to an integrated circuit in which the program is incorporated, the circuit being adapted for executing or being used in the execution of the method in question.

4. LIST OF FIGURES

Figure 2:
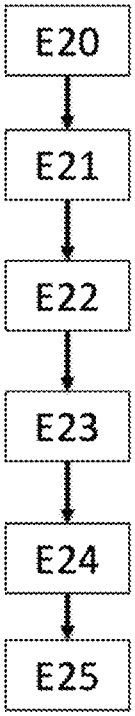
Figure 3:
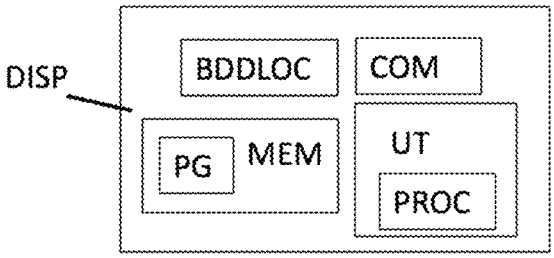
Figure 4:
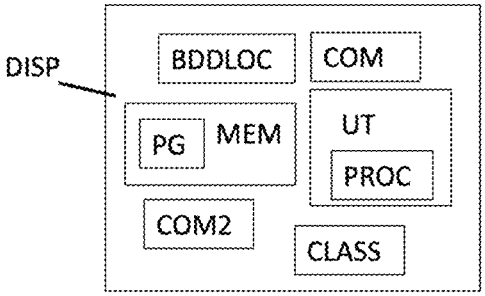
Figure 5:
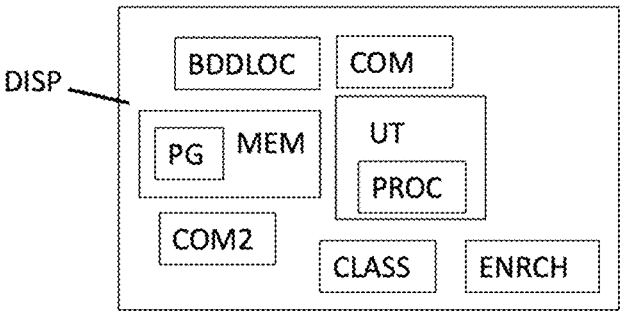

Other characteristics and advantages of the invention will appear more clearly from the following description of particular embodiments, given by way of simple illustratory and non-exhaustive examples, and from the appended drawings of which:

FIG. 1 illustrates an example of an environment for implementing the invention according to one particular embodiment of the invention, FIG. 2 illustrates steps in the method for identifying a scene in an environment, according to one particular embodiment of the invention, FIG. 3 schematically illustrates a device for identifying a scene in an environment, according to one particular embodiment of the invention, FIG. 4 schematically illustrates a device for identifying a scene in an environment, according to another particular embodiment of the invention, FIG. 5 schematically illustrates a device for identifying a scene in an environment, according to another particular embodiment of the invention.

5. DESCRIPTION OF AN EMBODIMENT OF THE INVENTION

The invention proposes, through the successive identification of sounds captured in an environment, the establishment of a use case that is associated with them.

By "use case", we mean here a set comprised of a context and an event. The context is defined by elements in the environment, such as location, stakeholders involved, the present time (day/night), etc.

The event is singular, occasional and transient. The event marks a transition or a breach in a situation encountered. For example, in a situation where a person is busy in a kitchen and is performing tasks to prepare a meal, an event could correspond to the moment when this person cuts his/her hand with a knife. According to this example, a use case is therefore defined by the context comprising the person present, the kitchen, and by the cutting accident event.

Another example of a use case is for example a scene where an occupant is departing from their home. According to this example, the context comprises the occupant of the home, the location (home entrance), elements with which the occupant is likely to interact during this use case (closet, keys, shoes, clothes, etc.), and the event is the departure from the home.

The invention identifies such use cases defined by a context and an event that occur in an environment. Such use cases are characterized by a chronological series of sounds generated by the movement and interactions between the elements/persons in the environment when the use case occurs. These may be sounds that are specific to the context or to the event of the use case. It is the successive identification of these sounds and according to the chronological order in which they are captured that the use case can be determined.

Hereon, the terms "situation", "use case" or "scene" will be used indifferently.

Described hereafter is FIG. 1, which illustrates an example of an environment for implementing the invention according to one particular embodiment of the invention, in relation with FIG. 2 illustrating the scene identification method.

The environment illustrated in FIG. 1 comprises in particular a system SYS to collect and analyze sounds captured in the environment via a set of sound capture means.

A network of sound capture means is located in the environment. Such sound capture means (C1, C2, C3) are for example microphones embedded into the various pieces of equipment situated in the environment. For example, in the case where the environment corresponds to a home, this could be microphones embedded into mobile terminals when the user who owns the terminal is at home, microphones embedded into terminals such as a computer, tablets, etc., and microphones embedded into all types of connected devices such as connected radio, connected television, personal assistant, terminals embedding microphone systems dedicated to sound recognition, etc.

Described here is the method according to the invention using three microphones. However, the method according to the invention can also be implemented with a single microphone.

Generally, the network of sound capture means can comprise all types of microphones embedded into computer or multimedia equipment already in place in the environment or specifically placed for sound recognition. The system according to the invention can use microphones already located in the environment for other uses. It is therefore not always necessary to specifically place microphones in the environment.

In the particular embodiment described here, the environment also comprises IoT connected devices, for example a personal assistant, a connected television or a tablet, home automation equipment, etc.

The system SYS to collect and analyze sounds communicates with the capture means and possibly with the IoT connected devices via a local network RES, for example a WiFi network of a home gateway (not represented).

The invention is not limited to this type of communication mode. Other communication modes are also possible. For example, the system SYS to collect and analyze sounds can communicate with the capture means and/or the IoT connected devices through Bluetooth or via a wired network.

According to one variant, the local network RES is connected to a larger data network INT, for example the Internet via the home gateway.

According to the invention, the system SYS to collect and analyze sounds identifies, from sounds captured in the environment, a scene or a use case.

In the particular embodiment described here, the system SYS to collect and analyze sounds comprises in particular:

a classification module CLASS,
an interpretation module INTRP,
an audio file database $BSND_{loc}$,
a sound class database $BCLSND_{loc}$,
a label database $BLBL_{loc}$,
a use case database $BSC_{loc}$.

The classification module CLASS receives (step E20) audio flows originating from capture means. For this, a specific application can be installed in the equipment in the environment that includes microphones, so that this equipment transmits the audio flow from the sound it captures. Such a transmission can be carried out continuously, or at regular intervals, or when a sound of a certain amplitude is detected.

Following the reception of an audio flow, the classification module CLASS analyzes the audio flow received to determine (step E21) the sound class or classes corresponding to the sound received via one or several prediction models derived from machine learning. The sounds from the sound database are matched with sound classes memorized in the sound class database $BCLSND_{loc}$. The classification module determines the sound class or classes corresponding to the sound received by selecting the sound class or classes associated with a sound from the sound database that is close to the sound received. The classification module therefore provides at output at least one class $CL_i$ of sounds associated with the sound received with a probability rate $P_i$. The sound classes selected for an analyzed sound correspond to an acceptable, predetermined probability threshold. In other terms, the only sound classes selected are those for which the probability rate that the sound received corresponds to a sound associated with the sound class is higher than a predetermined threshold.

The sound classes and their associated probability are then transmitted to the interpretation module INTRP in order for it to identify the scene that is occurring. For this, the interpretation module relies on a set of use cases stored in the use case database $BSC_{loc}$.

A use case is defined in the form of N marker sounds, with N being a positive integer greater than or equal to 2.

The use cases are predefined in an experimental manner and built using a succession of sounds characterizing each step of the scene. For example, in the case of a scene of a departure from home, the following succession of sounds was built: sound of a closet opening, sound of a coat being put on, sound of a closet closing, sound of footsteps, sound of a door opening, sound of a door closing, sound a of door being locked. Each scene construction was submitted to visually impaired persons to determine the relevance of the sound/steps chosen and to determine the marker sounds making it possible to identify the scene.

The experiment made it possible to identify that a number of three marker sounds is sufficient to identify a scene and to identity, for each scene, the marker sounds that characterize it, among the sounds in the succession of sounds built during the experiment.

In the particular embodiment of the invention described here, we therefore consider that N=3. Other values are possible however. The number of marker sounds can depend on the complexity of the scene to be identified. In other variants, only two marker sounds can be used, or additional marker sounds (N>3) can be added in order to define a scene or distinguish scenes that are acoustically too close. The number of marker sounds used to identify a scene can also vary in relation to the scene to be identified. For example, certain scenes could be defined by two marker sounds, other scenes by three marker sounds, etc. In this variant, the number of marker sounds is not fixed.

The use case database $BSC_{loc}$ was then filled with the defined scenes, each scene being characterized by three marker sounds according to a chronological order.

According to one particular embodiment of the invention, the scenes defined in the use case database $BSC_{loc}$ can come from a larger use case database BSC, for example predefined by a service provider according to the experiment described here above or any other method. The scenes memorized in the use case database $BSC_{loc}$ may have been pre-selected by the user, for example during an initialization phase. This variant makes it possible to adapt the possible use cases to be identified for a user in relation to their habits or their environment.

In order to identify a scene in progress, the interpretation module INTRP therefore relies on a succession of sounds received and analyzed by the classification module CLASS. For each sound received by the classification module CLASS, the latter transmits to the interpretation module INTRP at least one class associated with the sound received and an associated probability.

The interpretation module compares (step E22) the succession of sound classes recognized by the classification module, in the chronological order of capture of the corresponding sounds, with the marker sounds characterizing each scene from the use case database $BSC_{loc}$.

According to one particular embodiment of the invention, the interpretation module INTRP also takes account of the complementary data transmitted (step E23) to the interpretation module INTRP by connected devices (JOT) placed in the environment. Such complementary data can for example be information on the location of the captured sound, temporal information (time, day/night), temperature, service type information: for example, home automation information indicating that a light is switched on, a window is open, weather information provided by a server, etc., According to the particular embodiment of the invention described here, labels or qualifiers are predefined and stored in the label database $BLBL_{loc}$. These labels depend on the type and value of the complementary data likely to be received. For example, labels of the type: day/night are defined for complementary data corresponding to a schedule, labels of the type: hot/cold/moderate are defined for complementary data corresponding to temperature values, labels representing location can be defined for complementary data corresponding to the location of the captured sound.

In certain cases, the complementary data can also correspond directly to a label, for example, when the sound received by the classification module was transmitted by a connected device, the connected device can transmit with the audio flow, a location label corresponding to its location . . . .

The complementary data make it possible to qualify (i.e. describe semantically) a sound class or an identified scene. For example, for a captured sound corresponding to flowing water, information on the location of the captured sound will make it possible to qualify the sound class using a label associated with the location (for example: shower, kitchen, etc.). According to this example, the interpretation module INTRP can then qualify the sound class associated with a sound received.

According to another example, for a captured sound associated with two sound classes that are acoustically close, therefore with relatively close probability rates, information on the location of the captured sound will make it possible to determine the most likely sound class. For example, a label associated with location will help differentiate a sound class corresponding to water flowing from a faucet from a sound class corresponding to rain.

At output, the interpretation module provides the identified scene and an associated probability rate. Indeed, as for the identification of a sound class corresponding to a captured sound, the identification of a scene is performed by comparing captured sounds with marker sounds characterizing a use case. The captured sounds are not identical to the marker sounds, as the marker sounds may have been generated by elements other than those of the environment. In addition, the ambient noise of the environment can also impact sound analysis.

The interpretation module also provides at output for each sound class identified by the classification module, complementary data such as the identified scene, the data provided by the connected devices, the files of the captured sounds.

According to one particular embodiment of the invention, when a scene has been identified, the interpretation module INTRP transmits (step E24) the identification of the scene to a system of actuators ACT connected to the system SYS via the local network RES or via the data network INT when the system of actuators is not located in the environment. The system of actuators makes it possible to act accordingly in relation to the identified scene, by performing the actions associated with the scene. For example, this may concern triggering an alarm on identification of an intrusion, or notifying an emergency service on identification of an accident, or quite simply connecting the alarm on identification of a departure from the home.

According to one particular embodiment of the invention, the system SYS to collect and analyze sounds also comprises an enrichment module ENRCH. The enrichment module ENRCH updates (step E25) the sound database $BSND_{loc}$, the sound class database $BCLSND_{loc}$, the use case database $BSC_{loc}$, and the label database $BLBL_{loc}$ using information provided at output by the interpretation module (INTRP).

The enricher can therefore help to enrich databases using sound files of captured sounds, making it possible to improve analysis of subsequent sounds performed by the classification module and to improve the identification of a scene, by increasing the number of sounds associated with a sound class. The enricher also makes it possible to enrich databases using the labels obtained, for example by associating a captured sound memorized in the sound database $BSND_{loc}$ the label obtained for this sound is memorized in the label database.

The enrichment module makes it possible to enrich in a dynamic manner the data necessary for learning by the system SYS to improve the performance of this system.

In the example described here, the sound database $BSND_{loc}$, the sound class database $BCLSND_{loc}$, the use case database $BSC_{loc}$ and the label database $BLBL_{loc}$ are local. They are for example stored in the memory of the classification module or the interpretation module, or in a memory connected to these modules.

In other particular embodiments of the invention, the sound database $BSND_{loc}$, the sound class database $BCLSND_{loc}$, the use case database $BSC_{loc}$ and the label database $BLBL_{loc}$ can be remote. The system SYS to collect and analyze sounds accesses these databases, for example via the data network INT.

The sound database $BSND_{loc}$, the sound class database $BCLSND_{loc}$, the use case database $BSC_{loc}$ and the label database $BLBL_{loc}$ can comprise all or part of larger remote databases BSND, BCLSND, BSC and BLBL, for example existing databases or provided by a service provider.

These remote databases can be used to initialize the local databases of the system SYS and be updated using information collected by the system SYS on identification of a scene. In this way, the system SYS to collect and analyze sounds makes it possible to enrich the sound database, the sound class database, the use case database and the label database for other users.

According to the particular embodiment of described here above, the classification, interpretation and enrichment modules have been described as separate entities. However, all or part of these modules can be embedded into one or several devices as will be seen here below in relation to FIGS. 3, 4 and 5.

FIG. 3 schematically illustrates a device DISP for identifying a scene in an environment, according to one particular embodiment of the invention.

According to one particular embodiment of the invention, the device DISP has the classic architecture of a computer, and comprises in particular a memory MEM, a processing unit UT, equipped for example with a processor PROC, and piloted by the computer program PG stored in the memory MEM. The computer program PG comprises instructions to implement the steps of the method for identifying a scene such as described previously, when the program is executed by the processor PROC. At initialization, the instructions of the computer program code PG are for example loaded into a memory before being executed by the processor PROC. The processor PROC of the processing unit UT implements in particular, the steps of the method for identifying a scene according to one of the particular embodiments described in relation to FIG. 2, according to the instructions of the computer program PG.

The device DISP is configured for identifying a scene based on at least two sounds captured in said environment, each of said at least two sounds being associated respectively with at least one sound class, said scene being identified by taking account of the chronological order in which said at least two sounds were captured. For example, the device DISP corresponds to the interpretation module described in relation to FIG. 1.

According to one particular embodiment of the invention, the device DISP comprises a memory BDDLOC comprising a sound database, a sound class database, a use case database and a label database.

The device DISP is configured for communicating with a classification module configured for analyzing sounds received and transmitting one or more sound classes associated with a sound received, and possibly with an enrichment module configured for enriching databases such as sound databases, sound class databases, use case databases and label databases.

According to one particular embodiment of the invention, the device DISP is also configured for receiving at least one piece of complementary data provided by a connected device in the environment and associating a label with a sound class of a captured sound or with said identified scene.

FIG. 4 schematically illustrates a device DISP for identifying a scene in an environment, according to another particular embodiment of the invention. According to this other particular embodiment of the invention, the device DISP comprises the same elements as the device described in relation to FIG. 3. The device DISP also comprises a classification module CLASS configured for analyzing sounds received and for transmitting one or more sound classes associated with a sound received and a communication module COM2 adapted for receiving sounds captured by capture means in the environment.

FIG. 5 schematically illustrates a device DISP for identifying a scene in an environment, according to another particular embodiment of the invention. According to this other particular embodiment of the invention, the device DISP comprises the same elements as the device described in relation to FIG. 4. The device DISP also comprises an enrichment module ENRCH configured for enriching databases such as sound databases, sound class databases, use case databases and label databases.

The invention claimed is:

1. An identification device for identifying a scene in an environment, said environment comprising at least one sound capture device, said identification device comprising:

a processor; and a non-transitory computer-readable medium comprising instructions stored thereon which when executed by the processor configure the identification device to identify said scene among a group of predefined scenes, by:

obtaining at least two sounds of a chronological series of sounds generated by movement and interactions between elements in the environment when the scene occurs, wherein the at least two sounds were captured in said environment by the at least one sound capture device at different time instances;

associating each of said at least two sounds respectively with at least one sound class selected from among a plurality of sound classes; and identifying the scene from among the group of predefined scenes, wherein each predefined scene of the group is associated with a predetermined number of marker sounds arranged in chronological order, the identifying comprising:

comparing the sound classes associated with the at least two sounds and a chronological order at which the at least two sounds were captured, with the predetermined number of marker sounds and the chronological order of the predetermined number of marker sounds of at least one of the predefined scenes.

2. The identification device for identifying the scene according to claim 1, wherein the instructions configure the processor to receive at least one piece of complementary data provided by a connected device from said environment and associate a label with the sound class of least one of the captured sounds or with said identified scene.

3. The identification device for identifying the scene according to claim 2, wherein the instructions configure the processor to, in response to at least one of the captured sounds being associated with several sound classes, determine a sound class of the several sound classes for the at least one captured sound using said at least one piece of complementary data received.

4. The identification device for identifying the scene according to claim 1, wherein the instructions configure the processor to trigger at least one action to be performed following the identification of said scene.

5. The identification device for identifying the scene according to claim 1, wherein the instructions configure the processor to transmit to an enrichment device at least one part of the following data:

a piece of information indicating the scene identified, and at least two sound classes and a chronological order associated with the identified scene, at least one part of audio files corresponding to the captured sounds associated respectively with a sound class, at least one sound class associated with a label.

6. An identification system for identifying a scene in an environment, said environment comprising at least one sound capture device, wherein said identification system comprises:

a classification device configured to receive sounds captured by the at least one sound capture device in said environment, and determine, for each of the sounds received, at least one sound class selected from among a plurality of sound classes; and an identification device configured to identify said scene among a group of predefined scenes, by:

obtaining at least two sounds of a chronological series of sounds generated by movement and interactions between elements in the environment when the scene occurs, wherein the at least two sounds were captured by the classification device at different time instances, identifying the scene from among the group of predefined scenes, wherein each predefined scene of the group is associated with a predetermined number of marker sounds arranged in chronological order, the identifying comprising:

comparing the sound classes associated with the at least two sounds and a chronological order at which the at least two sounds were captured, with the predetermined number of marker sounds and the chronological order of the predetermined number of marker sounds of at least one of the predefined scenes.

7. The identification system for identifying the scene according to claim 6, further comprising an enrichment device, wherein:

the identification device is configured to transmit to the enrichment device at least one part of the following data:

a piece of information indicating the scene identified, and at least two sound classes and the chronological order associated with the identified scene, at least one part of audio files corresponding to the captured sounds associated respectively with a sound class, at least one sound class associated with a label; and the enrichment device is configured to update at least one database with at least one part of the data transmitted by the identification device.

8. An identification method for identifying a scene in an environment, said environment comprising at least one sound capture device, said method being performed by an identification device and comprising:

identifying a scene among a group of predefined scenes, by:

obtaining at least two sounds of a chronological series of sounds generated by movement and interactions between elements in the environment when the scene occurs, wherein the at least two sounds were captured in said environment by the at least one sound capture device at different time instances associating each of said at least two sounds respectively with at least one sound class selected from among a plurality of sound classes; and, identifying the scene from among the group of predefined scenes, wherein each predefined scene of the group is associated with a predetermined number of marker sounds arranged in chronological order, the identifying comprising:

comparing the sound classes associated with the at least two sounds and a chronological order at which the at least two sounds were captured, with the predetermined number of marker sounds and the chronological order of the predetermined number of marker sounds of at least one of the predefined scene.

9. The identification method according to claim 8, also comprising updating, at least one database by using at least one part of the following data:

a piece of information indicating the scene identified, and at least two sound classes and the chronological order associated with the scene identified, at least one part of audio files corresponding to the sounds captured associated respectively with a sound class, at least one sound class associated with a label.

10. A non-transitory computer-readable medium comprising instructions stored thereon which when executed by a processor of an identification device configure the identification device to identify a scene among a group of predefined scenes, by:

obtaining at least two sounds of a chronological series of sounds generated by movement and interactions between elements in the environment when the scene occurs, wherein the at least two sounds were captured in an environment by at least one sound capture device at different time instances, associating each of said at least two sounds is associated respectively with at least one sound class selected from among a plurality of sound classes; and identifying the scene from among the group of predefined scenes, wherein each predefined scene of the group comprises a predetermined number of marker sounds arranged in chronological order, the identifying comprising:

comparing the sound classes associated with the at least two sounds and a chronological order at which the at least two sounds were captured, with the predetermined number of marker sounds and the chronological order of the predetermined number of marker sounds of at least one of the predefined scenes.

* * * * *